US009683784B2

(12) United States Patent
Christians et al.

(10) Patent No.: US 9,683,784 B2
(45) Date of Patent: Jun. 20, 2017

(54) EVAPORATOR AND LIQUID DISTRIBUTOR

(71) Applicant: Carrier Corporation, Farmington, CT (US)

(72) Inventors: Marcel Christians, Skaneateles, NY (US); Jack L. Esformes, Jamesville, NY (US); Satyam Bendapudi, Fayetteville, NY (US); Martin Bezon, North Syracuse, NY (US); Xinliang Qiu, East Syracuse, NY (US); Sean P. Breen, Holyoke, MA (US)

(73) Assignee: CARRIER CORPORATION, Farmington, CT (US)

( * ) Notice: Subject to any disclaimer, the term of this patent is extended or adjusted under 35 U.S.C. 154(b) by 213 days.

(21) Appl. No.: 14/374,340

(22) PCT Filed: Jan. 25, 2013

(86) PCT No.: PCT/US2013/023124

§ 371 (c)(1),
(2) Date: Jul. 24, 2014

(87) PCT Pub. No.: WO2013/112818

PCT Pub. Date: Aug. 1, 2013

(65) Prior Publication Data

US 2014/0366574 A1 Dec. 18, 2014

Related U.S. Application Data

(60) Provisional application No. 61/591,456, filed on Jan. 27, 2012.

(51) Int. Cl.
*F28D 3/04* (2006.01)
*F25B 39/02* (2006.01)
(Continued)

(52) U.S. Cl.
CPC ..... *F28D 3/04* (2013.01); *F25B 39/028* (2013.01); *F28D 3/02* (2013.01); *F28D 21/0017* (2013.01); *F28D 2021/0071* (2013.01)

(58) Field of Classification Search
CPC ..... F28D 3/04; F28D 3/02; F28D 21/0017; F28D 2021/0071; F25B 39/028
See application file for complete search history.

(56) References Cited

U.S. PATENT DOCUMENTS 2,354,497 A * 7/1944 Brizzolara ..... F25B 39/02 62/219
3,635,040 A * 1/1972 Morris, Jr. ..... F25B 39/02 165/108

(Continued)

FOREIGN PATENT DOCUMENTS

CA 2716686 A1 4/2011
CN 201527214 U 7/2010

(Continued)

OTHER PUBLICATIONS

PCT International Preliminary Report on Patentability and Written Opinion of the International Searching Authority for International Application No. PCT/US2013/023124, Aug. 7, 2014, 6 pages.

(Continued)

*Primary Examiner* — Emmanuel Duke
(74) *Attorney, Agent, or Firm* — Cantor Colburn LLP

(57) ABSTRACT

A liquid distributor delivers a falling flow of the liquid to be distributed substantially uniformly along a longitudinal extent of the liquid distributor. The liquid distributor has a bottom wall including a longitudinally extending distribution plate having a plurality of laterally spaced and longitudinally extending channels. A shell and tube evaporator for chilling a working fluid incorporates the liquid distributor as a distributor of liquid onto the heat exchange tubes of a tube bundle disposed within an interior volume of the shell. Each (Continued)

channel is aligned with a respective column of the plurality of vertical columns of heat exchange tubes and is configured to deliver a falling flow of liquid refrigerant onto the respective tube column substantially uniformly along the longitudinal extent of the respective tube column.

23 Claims, 7 Drawing Sheets

(51) Int. Cl.
*F28D 3/02* (2006.01)
*F28D 21/00* (2006.01)

(56) References Cited

U.S. PATENT DOCUMENTS 5,417,805 A 5/1995 Rosenblad
5,419,810 A 5/1995 Van Der Piepen et al.
5,419,814 A 5/1995 Kunihiro et al.
5,509,471 A 4/1996 Hallgren
5,561,987 A 10/1996 Hartfield et al.
5,575,889 A 11/1996 Rosenblad
5,588,596 A 12/1996 Hartfield et al.
5,624,531 A 4/1997 Knuutila et al.
5,638,691 A 6/1997 Hartfield et al.
5,645,124 A 7/1997 Hartfield et al.
5,667,643 A 9/1997 Satchell, Jr. et al.
5,709,264 A 1/1998 Sweeney et al.
5,716,496 A 2/1998 Agren
5,755,279 A 5/1998 Sweeney et al.
5,761,914 A 6/1998 Carey et al.
5,823,252 A 10/1998 Waitkat et al.
5,837,096 A 11/1998 Fagerlind et al.
5,849,148 A 12/1998 Walker
5,853,549 A 12/1998 Sephton
5,922,903 A 7/1999 Pujado
6,066,232 A 5/2000 Mohr et al.
6,089,312 A 7/2000 Biar et al.
6,167,713 B1 1/2001 Hartfield et al.
6,168,141 B1 1/2001 Zimmer
6,176,101 B1 1/2001 Lowenstein
6,251,341 B1 6/2001 Zimmer
6,253,571 B1 7/2001 Fujii et al.
6,293,112 B1 * 9/2001 Moeykens ..... F25B 39/02 165/115
6,309,513 B1 10/2001 Sephton
6,516,627 B2 2/2003 Ring et al.
6,596,244 B1 7/2003 Pujado
6,606,882 B1 8/2003 Gupte
6,695,043 B1 2/2004 Wagner et al.
6,830,099 B2 12/2004 Moeykens
6,830,654 B1 12/2004 Salmisuo
6,868,695 B1 * 3/2005 Dingel ..... F25B 39/028 165/115
6,887,345 B2 5/2005 Hirvonen et al.
7,055,588 B2 6/2006 Nickolay et al.
7,112,262 B2 9/2006 Bethge
7,118,098 B2 10/2006 Thiel et al.
7,228,711 B2 6/2007 Taras et al.
7,414,159 B2 8/2008 Stroefer et al.
7,487,926 B2 2/2009 Knol et al.
7,591,930 B2 9/2009 Glasl et al.
7,658,817 B2 2/2010 Fukuoka et al.
7,677,301 B2 3/2010 Blomgren
7,849,710 B2 12/2010 De Larminat et al.
7,959,133 B2 6/2011 Liu et al.
7,959,768 B2 6/2011 Porscha et al.
2002/0162352 A1 11/2002 Ring et al.
2004/0107597 A1 6/2004 Hirvonen et al.
2004/0112573 A1 * 6/2004 Moeykens ..... F25B 39/028 165/115
2004/0206487 A1 10/2004 Blomgren
2004/0245084 A1 12/2004 Bethge
2004/0251003 A1 12/2004 Nickolay et al.
2005/0205215 A1 9/2005 Giddings et al.
2006/0060305 A1 3/2006 Klemm et al.
2006/0101848 A1 5/2006 Taras et al.
2006/0150665 A1 7/2006 Weimer et al.
2007/0106096 A1 5/2007 Stroefer et al.
2007/0246574 A1 10/2007 Kolb et al.
2008/0017325 A1 1/2008 Fukuoka et al.
2008/0110578 A1 5/2008 Fukuoka et al.
2008/0148767 A1 6/2008 De Larminat et al.
2008/0191153 A1 * 8/2008 Marganski ..... B01J 7/00 250/492.21
2008/0196839 A1 8/2008 Porscha et al.
2008/0196840 A1 8/2008 Fukuoka et al.
2008/0289773 A1 11/2008 Fukuoka et al.
2009/0178790 A1 * 7/2009 Schreiber ..... F25B 39/028 165/158
2010/0107676 A1 5/2010 Liu et al.
2010/0242533 A1 9/2010 De Larminat et al.
2010/0276130 A1 11/2010 De Larminat et al.
2010/0319395 A1 12/2010 De Larminat et al.
2010/0326108 A1 12/2010 Schreiber et al.
2011/0017432 A1 * 1/2011 Kulankara ..... F28D 3/02 165/115
2011/0023515 A1 2/2011 Kopko et al.
2011/0056664 A1 * 3/2011 De Larminat ..... F25B 39/028 165/160
2011/0079503 A1 4/2011 Heins et al.
2011/0083833 A1 4/2011 Zorzin et al.
2011/0100561 A1 5/2011 Alasti et al.
2011/0120181 A1 5/2011 De Larminat et al.
2011/0120672 A1 5/2011 Ringwaldt
2011/0226606 A1 9/2011 Feng et al.

FOREIGN PATENT DOCUMENTS

EP 0780646 A2 6/1997
GB 599400 A 3/1948
GB 1055978 A 1/1967
JP 0262063 A 2/2002
JP 2005502016 A 1/2005
JP 2010243050 A 10/2010
WO 9500810 A1 1/1995
WO 9505226 A1 2/1995
WO 9523015 A1 8/1995
WO 9637740 A1 11/1996
WO 9637741 A1 11/1996
WO 9962318 A2 12/1999
WO 0055552 A1 9/2000
WO 0144730 A1 6/2001
WO 03001130 A2 1/2003
WO 2008080085 A2 7/2008
WO 2009089503 A2 7/2009
WO 2009089514 A2 7/2009
WO 2011011421 A2 1/2011

OTHER PUBLICATIONS

PCT International Search Report and the Written Opinion of the International Searching Authority, or the Declaration for International Application No. PCT/US2013/023124, Mar. 28, 2013, 10 pages.
Chinese Patent No. 201527214; Date of Publication: Jul. 14, 2010; Abstract Only, 1 page.

* cited by examiner

EVAPORATOR AND LIQUID DISTRIBUTOR

CROSS-REFERENCE TO RELATED APPLICATIONS

This patent application claims priority to U.S. Provisional Patent Application Ser. No. 61/591,456 filed Jan. 27, 2012, which is incorporated herein by reference in its entirety.

BACKGROUND

Exemplary embodiments pertain generally to the art of liquid dispensing and to the art of heat exchangers and, more particularly, to the distribution of liquid over the tube banks of an evaporator of a refrigeration chiller.

Refrigeration chillers are commonly used for chilling a working fluid, such as water, to be supplied to heat exchangers associated with a climate-controlled space of a building for conditioning air drawn for the climate-controlled space and passed in heat exchange relationship with the chilled working fluid thereby cooling the air. Refrigeration chillers include a refrigerant vapor compressor, a refrigerant vapor condenser, a refrigerant liquid evaporator, and a refrigerant flow metering device. Depending upon the refrigerant employed, the chiller may be characterized as a high-pressure refrigerant chiller, a medium-pressure refrigerant chiller, or a low-pressure refrigerant chiller.

In the evaporator, which typically is a shell and tube heat exchanger, the working fluid to be chilled is circulated through a plurality of heat exchange tubes arrayed in one or more tube bundles. The refrigerant liquid to be evaporated is fed into the interior of the shell of the evaporator and brought in heat exchange relationship with the refrigerant passing through the heat exchange tubes arrayed in the one or more tube bundles, whereby the liquid refrigerant is evaporated and the working fluid chilled. The working fluid passing from the evaporator is circulated back through the heat exchangers associated with the climate-controlled space. The refrigerant vapor formed in the evaporator circulates back to the compressor to be compressed to a higher pressure, higher temperature vapor state, then passed through the condenser to be condensed back to a liquid state, thence expanded to a lower pressure in passing through the refrigerant flow metering device and fed back into the interior of the evaporator shell.

Typically, in medium and high-pressure falling-film refrigerant chillers, the liquid refrigerant fed to the evaporator is forced through a plurality of spray nozzles to be distributed over the tube bundles. The spray nozzles are arrayed and the nozzle spray patterns designed such that even liquid distribution is achieved over the length of the tube bundles. The use of such spray nozzles entails a non-negligible pressure drop in refrigerant pressure. In medium and high-pressure refrigerant chillers, the resultant pressure drop is not a significant problem due to the relatively large difference between the condensing and evaporating pressures associated with the medium and high-pressure refrigerants. However, in low-pressure refrigerant chiller systems, the high pressure drop attendant with the use of such spray nozzles can be prohibitive due to the inherently low difference between the condensing and evaporating temperatures associated with low-pressure.

SUMMARY

In an aspect of the disclosure, a liquid distributor is provided for delivering a falling film of liquid onto a target disposed beneath the liquid distributor. The liquid distributor includes an enclosure having a bottom wall including a longitudinally extending distribution plate, said distributor plate having a plurality of laterally spaced and longitudinally extending channels, each channel of said plurality of channels configured to deliver a falling flow of the liquid to be distributed substantially uniformly along a longitudinal extent of the liquid distributor. Each channel includes an upper slot extending uninterruptedly along the longitudinal extent of the distributor plate and a plurality of lower slits disposed at longitudinally spaced intervals beneath and in flow communication with the upper slot. In an embodiment, a porous material may be disposed within the upper slot. In an embodiment, a perforated plate having a plurality of holes therethrough may be disposed superadjacent an upper surface of the distributor plate, the holes arranged at longitudinally spaced intervals in a plurality of laterally spaced columns that are aligned with the channels in the distributor plate.

In an embodiment, a trough extends outwardly from an undersurface of the distributor plate and longitudinally beneath the upper slot. The trough includes a plurality of lower slits disposed at longitudinally spaced intervals beneath and in flow communication with the upper slot. The trough has a distal tip having outer sides that converge inwardly at an angle with the horizontal in the range of 45 to 60 degrees.

In an aspect of the disclosure, a shell and tube evaporator for chilling a working fluid includes a shell defining an interior volume, a tube bundle disposed within the interior volume of the shell, and a refrigerant distributor disposed within the interior volume above the tube bundle. The tube bundle includes a plurality of longitudinally extending heat exchange tubes arranged in an array of a plurality of vertical tube columns and a plurality of horizontal tube rows. The refrigerant distributor has a bottom wall including a longitudinally extending distribution plate having a plurality of laterally spaced and longitudinally extending channels. Each channel is aligned with a respective column of the plurality of vertical columns of heat exchange tubes and is configured to deliver a falling flow of liquid refrigerant onto the respective tube column substantially uniformly along the longitudinal extent of the respective tube column. Each channel includes an upper slot extending uninterruptedly along the longitudinal extent of the channel and a plurality of lower slits disposed at longitudinally spaced intervals beneath and in flow communication with the upper slot.

BRIEF DESCRIPTION OF THE DRAWINGS

For a further understanding of the disclosure, reference will be made to the following detailed description which is to be read in connection with the accompanying drawing, wherein.

DETAILED DESCRIPTION

Figure 1:
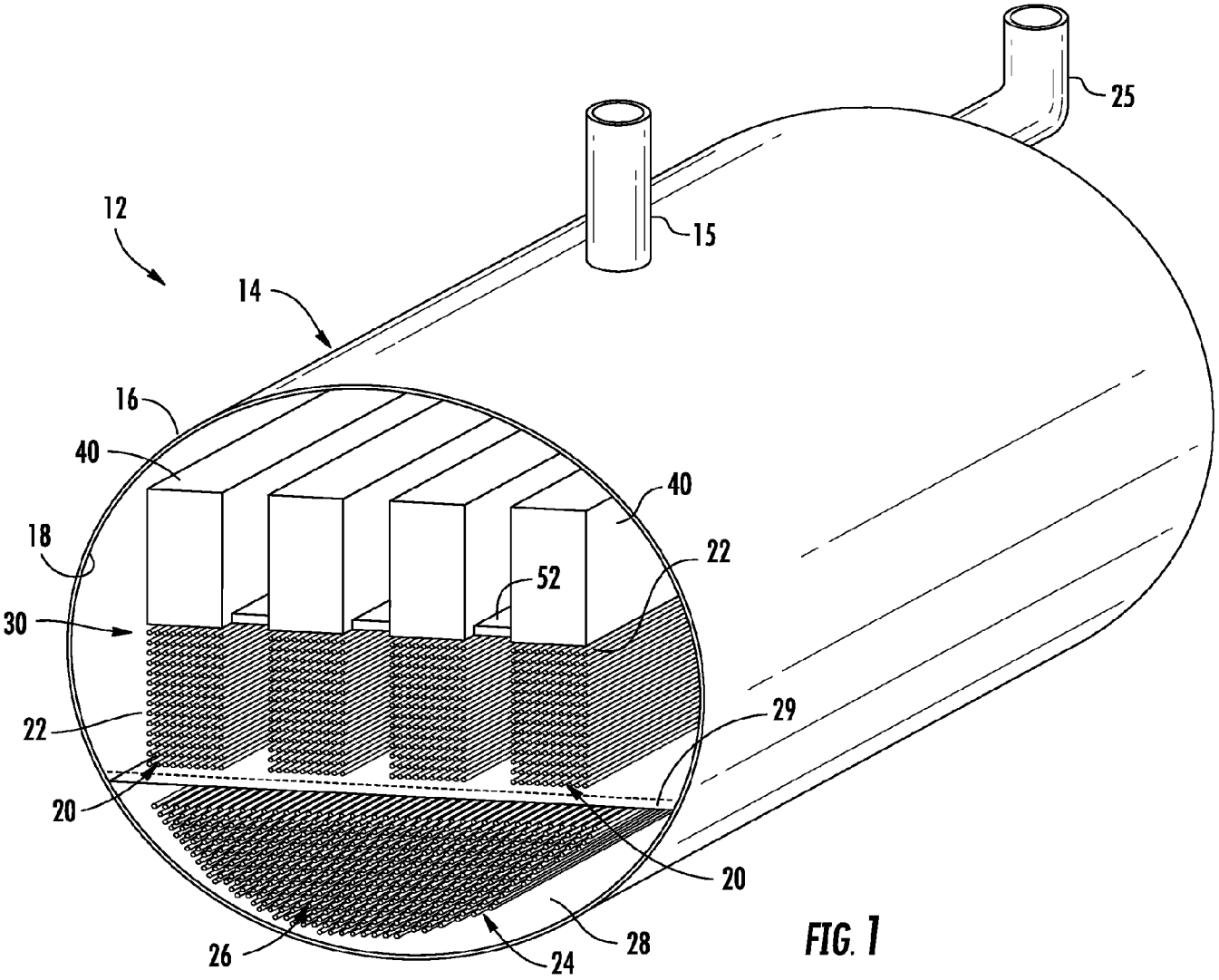
FIG. 1 is a partial perspective view of a shell and tube evaporator employing a low pressure refrigerant in accordance with an exemplary embodiment.

Referring initially to FIG. 1, there is depicted an embodiment of a shell and tube evaporator, in accordance with an exemplary embodiment is indicated generally at 12, employing a low-pressure refrigerant to lower a temperature of a fluid to be chilled. Shell and tube evaporator 12 includes a shell 14 having an outer surface 16 and an inner surface 18 that define a heat exchange zone 10 within the interior of the shell 14, and a plurality of tube bundles 20 disposed within the interior of the shell 14. Each tube bundle 20 includes a plurality of heat exchange tubes 22 arrayed in spaced relationship in a column and row matrix. In the exemplary embodiment shown, shell 14 has a generally oval cross-section. However, it should be understood that shell 14 may take on a variety of forms including both circular and non-circular.

Shell 14 includes a refrigerant inlet 15 that is configured to receive liquid refrigerant or a mix of liquid and vapor refrigerant from a source of refrigerant (not shown). Shell 14 also includes a vapor outlet 25 opening to the interior of the shell 14 that is configured to connect to an external device such as a compressor (not shown). Shell and tube evaporator 12 is also shown to include a refrigerant pool boiling zone 24 arranged in a lower portion of shell 14. The refrigerant pool boiling zone 24 includes a pool tube bundle 26 through which a heating fluid is passed in heat exchange relationship with a pool 28 of refrigerant collecting in the refrigerant pool boiling zone 24. Pool 28 of refrigerant includes an amount of liquid refrigerant having an upper surface 29. The heating fluid circulating through the pool tube bundle 26 exchanges heat with pool 28 of refrigerant to convert an amount of refrigerant from a liquid to a vapor state.

As noted previously, shell and tube evaporator 12 includes a plurality of tube bundles 20 that collectively form a falling-film evaporator designated generally at 30. However, it should be understood that while shown with a plurality of tube bundles 20 are shown in FIG. 1, any number of tube bundles 20, including a single tube bundle, could also be employed as a falling-film evaporator in connection with shell and tube evaporator 12. Each tube bundle 20 includes a plurality of heat exchange tubes 22 arrayed in spaced relationship in a column and row matrix. The number of tubes 22 in each column and row is a matter of design choice. Each tube 22 provides a flow passage through which a fluid to be chilled, such as for example, but not limited to, water or a water/glycol mix, and acts as a heat exchange interface between the low-pressure refrigerant fed into the interior of the shell 14 and the fluid to be chilled. In the embodiment of the evaporator 12 depicted in FIG. 1, the tube bundles 20 may be disposed in laterally spaced relationship within the interior of the shell 14 with the lowermost row of tubes 22 of each bundle 20 being spaced above the surface 29 of the pool 28 of liquid refrigerant.

The evaporator 12 further includes a plurality of modular liquid distributors 40 in operative association with the plurality of tube bundles 20 of the falling film evaporator 30. Each liquid distributor has at least one inlet 32 for receiving liquid refrigerant, or a mix of liquid and vapor refrigerant, passing through the liquid inlet 15. Each modular liquid distributor 30 is paired in association with a respective one of the plurality of tube bundles 20 of the falling film evaporator 30 for distributing liquid refrigerant substantially uniformly onto the tube bundles 20, as will be more fully explained below. As depicted in FIG. 1, each liquid distributor 40 is disposed in spaced relationship with and above the uppermost row of tubes 22 in a respective tube bundle 20. As each liquid distributor 40 and associated tube bundle 20 is substantially similar in construction, arrangement and functionally, a detailed description will follow with reference to a pair of liquid distributors 40 and a pair of associated tube bundles 20, understanding that an arrangement with one or three or more liquid distributors 40 and associated tube bundles 20 would be similarly constructed, arranged and operated.

Figure 2:
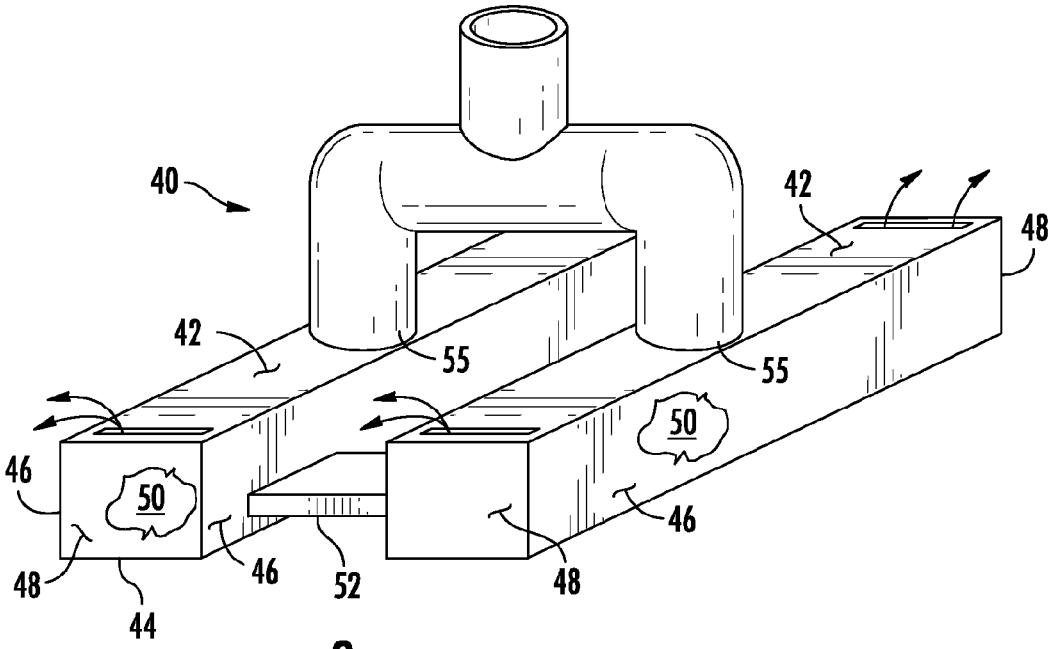
FIG. 2 is a perspective view of an embodiment of a liquid distributor as disclosed herein.
Figure 3:
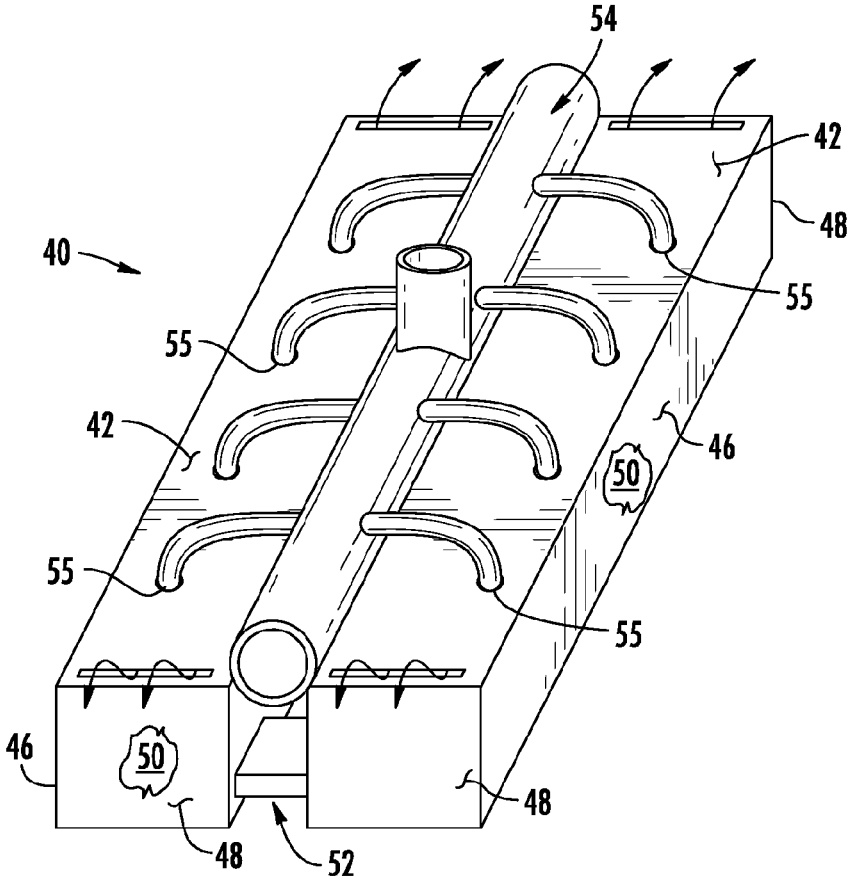
FIG. 3 is a perspective view of another embodiment of a liquid distributor as disclosed herein.

Referring now to FIGS. 2 and 3, there are depicted embodiments of an assembly of two liquid distributors 40 with an associated falling film evaporator 30 having two cells 36 aligned with the two liquid distributors 40. Each modular liquid distributor 40 comprises a longitudinally extending, generally rectangular parallel piped enclosure having a top wall 42, a bottom wall 44, a pair of laterally spaced side walls 46, and a pair of longitudinally spaced end walls 48, collectively defining an interior volume, referred to herein as a liquid distribution chamber. The modular liquid distributors 40 are disposed in parallel laterally spaced relationship with each liquid distributor disposed in alignment with and above a respective tube bundle 20. The lower regions of the respective liquid distribution chambers 50 may be interconnected by at least one liquid leveling connector 52, and generally by a plurality of liquid leveling connectors.

Each liquid distributor 40 is fed with liquid refrigerant, or a mix of liquid and vapor refrigerant, through at least one inlet opening 55, such as depicted in FIG. 2, or through a plurality of longitudinally spaced inlet openings 55, such as depicted in FIG. 3, disposed in the top wall 42 of the liquid distributor 40. In the FIG. 2 embodiment, the inlet opening 55 to each liquid distributor 40 is connected in flow communication directly with the liquid inlet 15 for receiving the refrigerant being fed to the shell and tube evaporator 12. In the FIG. 3 embodiment, each of the plurality of inlet openings 55 to each liquid distributor 40 is connected in flow communication with the liquid inlet 15 via a longitudinally extending liquid manifold 54 for receiving the refrigerant being fed to the shell and tube evaporator 12. Refrigerant liquid flows from the liquid distribution chamber 50 of each liquid distributor 40 through outlet openings in each bottom wall 44 downwardly in the direction of gravity and falls on the tubes 22 of the tube bundles 20 disposed below the liquid distributors 40. Liquid refrigeration falling upon the tubes 22 forms a thin film on the external surface of the tubes 22 and is evaporated by heat transferred from the higher temperature fluid to be chilled conveyed through the flow passages of the tubes 22.

Figure 4:
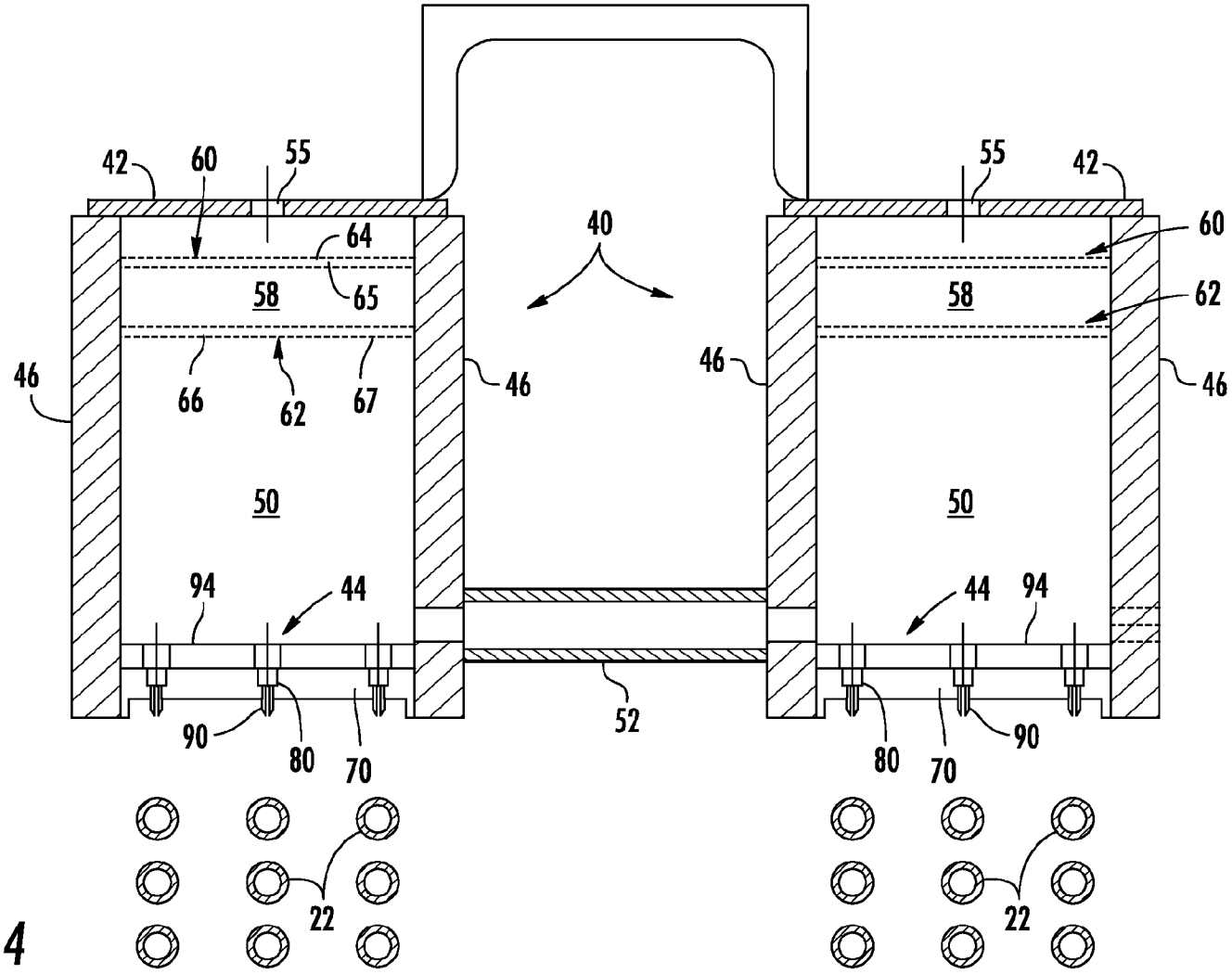
FIG. 4 is a sectioned side elevation view of an embodiment of the liquid distributor as disclosed herein.

Referring now to FIG. 4, each liquid distributor 40 includes a first flow restrictor 60 disposed in an upper region 58 of the liquid distribution chamber 50. The first flow restrictor 60 is configured to initially redistribute the refrigerant feed flow received through the inlet opening 55 or inlet openings 55 at least laterally across the lateral extent of the falling film evaporator 30. The liquid distributor 40, may, if desired, also include a second flow restrictor 62 disposed in the upper region 58 of the liquid distributor chamber 50 downstream with respect to liquid refrigerant flow, that is beneath, the first flow restrictor 60. The second flow restrictor 62 is configured to initially redistribute the refrigerant feed flow having passed through the first flow restrictor 60 longitudinally along the length of the liquid distributor 40. In the embodiment of the liquid distributors 40 depicted in FIG. 4, the first flow restrictor 60 comprises a first perforated plate 64 and the second flow restrictor 62 comprises a second perforated plate 66. The first perforate plate 64 has a plurality of holes 65 passing therethrough, the holes 65 selectively arranged to force a lateral redistribution of the liquid refrigerant passing therethrough. The second perforated plate 66 has a plurality of holes 67 passing therethrough, holes 67 selectively arranged to force a longitudinal redistribution of the liquid refrigeration passing therethrough.

The liquid refrigerant having passed through the first and second flow restrictors 60, 62, that is having passed through the holes 65, 67 in the perforated plate flow restrictors 64, 66, respectively, drops to the lower region of the liquid distribution chamber 50 and collects on the bottom wall 44 to form a refrigerant pool in the lower region of the liquid distribution chamber 50. The bottom wall 44 of each liquid distributor 40 comprises a distributor plate 70 that is configured to distribute the liquid refrigerant along the length of the tubes 22 in the respective tube bundles 22 forming the cells 30 disposed beneath the respective liquid distributors 40.

Figure 9:
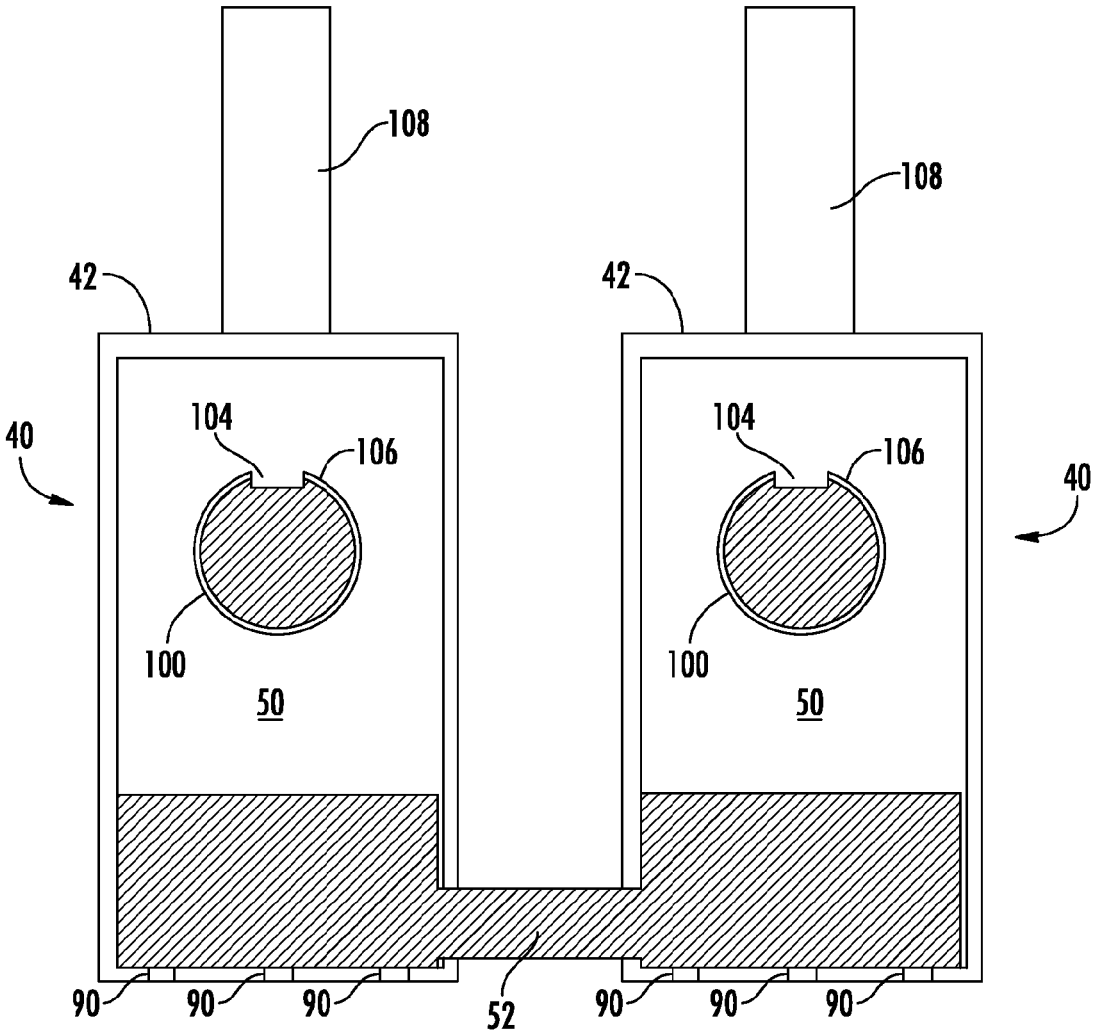
FIG. 9 is a cross-sectional view of another embodiment of a liquid distributor.
Figure 10:
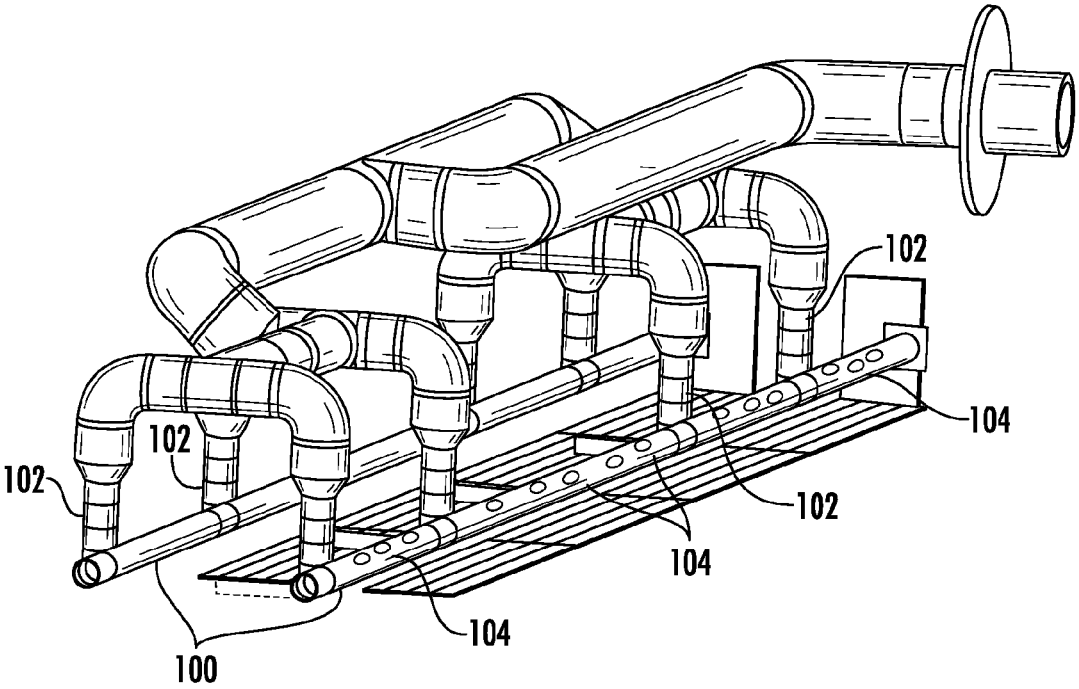
FIG. 10 is a perspective view of another embodiment of the liquid distributor.

In another embodiment, as illustrated in FIG. 9, the perforated plate flow restrictors 64, 66 are replaced by a sparge pipe 100 located in the liquid distributor 40. The sparge pipe 100 is a tubular structure extending longitudinally along the liquid distributor 40 and receives liquid and/or vapor refrigerant through inlet openings 55 via sparge inlet pipes 102, as shown in FIG. 10. The sparge pipe 100 further includes a plurality of sparge openings 104 interposed with the sparge inlet pipes 102 along a upper portion 106 of the sparge pipe 100. The sparge openings 104 may be substantially circular as shown, or may be other shapes, for example, elongated slots. In some embodiments, the liquid distributors 40 include one or more vent openings or vent pipes 108 extending, for example, through the top wall 42 to vent any entrained vapor refrigerant out of the liquid distribution chamber 50 into the interior of the shell 14 and out of the evaporator via the vapor outlet 25 (shown in FIG. 1). In some embodiments, the vent pipes 106 are located at of near longitudinal ends of the liquid distributors 40.

Referring again to FIG. 9, in operation, liquid refrigerant enters the sparge pipe 100 via the sparge inlet pipes 102. The sparge pipe 100 fills and the pressure of liquid refrigerant in the sparge pipe 100 urges the liquid refrigerant out of the sparge openings 104 and into the distribution chamber 50. Under some conditions, flashing of the liquid refrigerant may occur, resulting in some amount of vapor refrigerant in the liquid distributors 40. This vapor refrigerant in vented out through the vent pipes 108.

Figure 5:
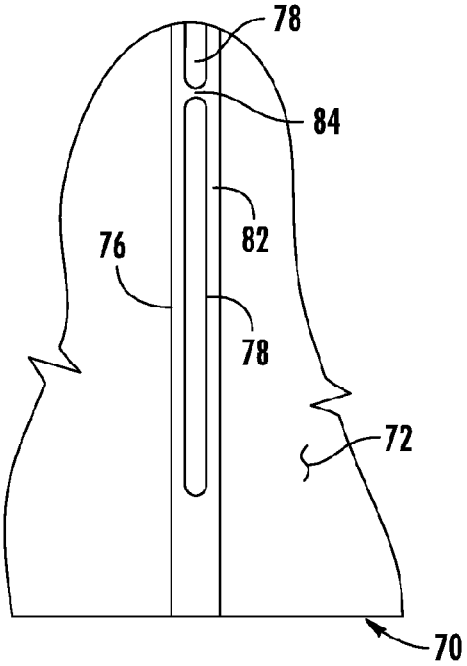
FIG. 5 is a sectioned side elevation view of the distributor plate of the liquid distributor as disclosed herein.
Figure 6:
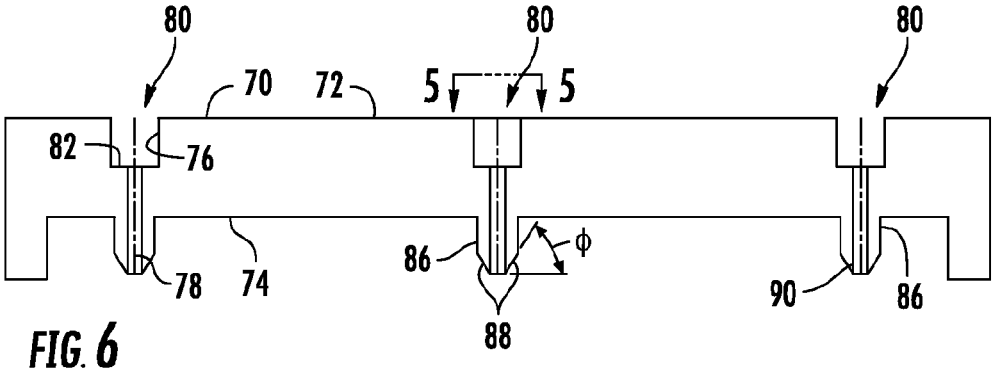
FIG. 6 is a sectioned plan view of the distributor plate of FIG. 5 taken along line 6-6.

Referring now to FIGS. 5 and 6, distributor plate 70 has a lateral extent, a longitudinal extent, and a thickness as measured from an upper surface 72 thereof to a under surface 74 thereof. The distributor plate 70 includes a plurality of laterally spaced, longitudinally extending channels 80 equal in number to the number of columns of tubes 22 in the respective tube bundle 20 positioned below the distributor plate 70. Each channel 80 is aligned along its length with a respective column of tubes 22. Each channel 80 includes a upper slot 76 and a plurality of lower slits 78. The upper slots 76, which have a generally rectangular cross-section, are formed in the upper surface 72 of the distributor plate 70 and extend longitudinally uninterrupted from a forward edge 77 of the distributor plate 70 to a trailing edge 79 of the distributor plate 70. The upper slots 76 have a depth as measured from the upper surface 72 of distributor plate 70 to an inner face, i.e. floor 82, of the upper slot 76 and an open width as measured laterally, i.e. transversely to the longitudinal length of upper slot 76. The depth of each upper slot 76 is less than the thickness of the distributor plate 70. In an embodiment, the upper slots 76 have a square cross-section wherein the width and depth of the upper slot are equal and the depth of the upper slot extends to about one-half the thickness of the distributor plate 70.

The plurality of lower slits 78 are formed in the floor 82 of each upper slot 76 at longitudinally spaced intervals and penetrate the floor 82 of each upper slot 76. Each of the lower slits 78 extend longitudinally a preselected length and have a width that is smaller than the width of the upper slot 76. Thus, the lower slits 78 are thinner than and shorter than the upper slots 76. For example, the lower slits 78 may have a width that is less than 50% of the width of the upper slots 76, and in an embodiment have a width that is 40% of the width of the upper slots 76. The lower silts 78 may have a length to width ratio in the range from 20 to 1 to 25 to 1.

A pattern of the thinner lower slits 78 separated longitudinally by small spaces is machined straight through the remaining thickness of the distributor plate 70 from the floor 82 of each upper slot 76 to the under surface 74 of the distributor plate 70. In an embodiment, the small spaces 84 separating the longitudinally disposed lower slits 78 may have a length that is about 1/16 the length of the lower slits 78. Therefore, each channel 80 defines a plurality of liquid flow passages extending through the distributor plate 70.

After passing through the under surface 74, the lower slits 78 continue through a longitudinally extending troughs 86 that extend downwardly from the under surface 74 of the distributor plate 70 to terminate in a distal tip 90, as best seen in FIG. 5. The outer sides 88 of the distal tips 90 are angled inwardly at an acute angle, $\phi$, with the horizontal. In an embodiment, the outer sides 88 of the distal tip 90 of each trough 86 are angled inwardly at an angle between 45 degrees and 60 degrees. In an embodiment, the longitudinally extending nipples 86 may be formed integral with the distributor plate 70. The angled outer sides 88 of the distal tip 90 of the longitudinally extending troughs 86 ensure that liquid tension does not cause the liquid refrigerant flowing out the lower slits 78 to adhere to the under surface of the distributor plate 70.

If the lower slits 78 beneath the upper slots 76 also extended longitudinally uninterruptedly the length of the channels 80 and there is adequate refrigerant flow, the refrigerant would discharge from each channel 80 as a longitudinally extending, uninterrupted, solid sheet of falling refrigerant. The un-machined spaces 84 separating the lower slits 78 break up the solid sheet pattern that would occur naturally if the lower slits 78 also extended longitudinally uninterruptedly beneath the upper slots 76. The narrow lower slits 78 also provide sufficient flow restriction that a head of refrigerant collects on the upper surface 72 of the distributor plate 70. The establishment of this head of refrigerant in combination with the un-machined spaces 84 separating the longitudinally extending lower slits 78 ensures that refrigerant will discharge from the lower slits 78 in the form of stable columns. Additionally, the sharp edge established on the distal tip 90 of the troughs 86 by the angled outer sides 88 ensures a neat transition between flow within the lower slits 78 to a falling liquid film and focuses the falling liquid film onto the tubes 22 therebeneath.

Figure 7:
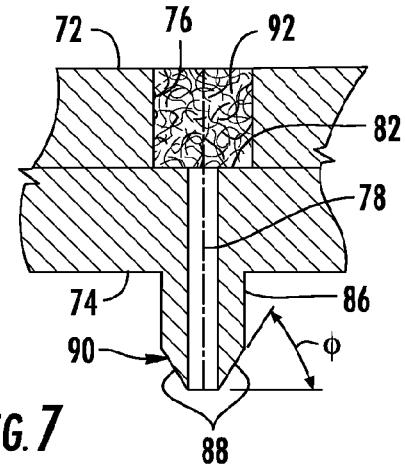
FIG. 7 is a sectioned side elevation view of a channel in the distributor plate of FIG. 5 in an embodiment of the liquid distributor wherein a porous medium is disposed in an upper slot of the channel.
Figure 8:
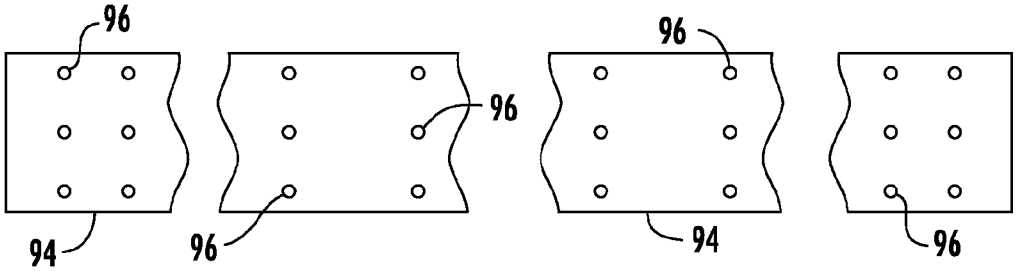
FIG. 8 is a plan view of a perforated plate superadjacent the distributor plate of FIG. 5 in an alternate embodiment of the liquid distributor disclosed herein.

Referring now to FIG. 7, a porous media 92 may be disposed within upper slots 76 of one or more or all of the open channels 80. The porous media 92 may extend longitudinally the entire length of the channel 70. The porous media 92 allows the passage of liquid refrigerant through the upper slot 76 of channel 80, but provides an additional flow resistance that facilitates a more uniform distribution of liquid along the entire length of channel 80. In an embodiment where the liquid passing through the liquid distributor 70 is refrigerant, the porous media 92 comprises an aluminum foam, for example, but not limited to, aluminum alloy 6101 foam. It is to be understood that other porous materials, including other foam materials, may be used as the porous media 92 so long as that material is compatible, such as from a corrosion and durability standpoint, with the particular liquid passing through the liquid distributor 70.

In another embodiment, a further perforated plate 94 may be disposed superadjacent the upper surface 72 of the distributor plate to as depicted in FIG. 7. The perforated plate 94 has a plurality of holes 96 extending therethrough. The holes 96 are arranged in a pattern of laterally spaced, longitudinally extending rows. Each row of holes 96 is disposed above a respective one of the columns 70. The holes 96 within a row are disposed at longitudinally spaced intervals along the entire length of the channel 80. In this embodiment, the holes 96 extending through the perforated plate 94 provide the only liquid flow path flow for liquid collecting above the distributor plate 70 to pass into the channels 80. The holes 96 may be selectively located within the rows to provide a desired distribution of liquid flow along the length of each channel 80, the ultimate goal being to a liquid distribution over the length of the tubes 22 in the tube bundle 20 associated with the liquid distributor 70 is as uniform as possible.

The shell and tube evaporator 12 equipped with one or more liquid distributors 40 as disclosed herein is well suited for use in connection with low-pressure refrigerants. For example, a refrigerant having a liquid phase saturation pressure below about 45 psi (310.3 kPa) at 104° F. (40° C.) constitutes a low-pressure refrigerant. One example of a low-pressure refrigerant includes R245fa. However, it should also be understood that the exemplary embodiments of the liquid distributor disclosed herein could also be employed in a shell and tube falling film evaporator in chiller systems using a medium-pressure refrigerant, such as for example R134a, or a high-pressure refrigerant, such as for example R410a.

Further, although the liquid distributor 40 disclosed herein has been described with reference to application as a refrigerant distributor for delivering liquid refrigerant onto the tube bundles 20 of the falling film evaporator 30 of the shell and tube evaporator 12 of a chiller system, it is to be understood that use of the liquid distributor 40 is not limited to such application. Rather, the liquid distributor 40 as disclosed herein may be used in other applications wherein it is desired to configured to deliver a falling flow of the liquid to be distributed substantially uniformly along a longitudinal extent of the liquid distributor.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

We claim:

1. A shell and tube evaporator for chilling a working fluid comprising: a shell defining an interior volume and having a refrigerant inlet; a tube bundle disposed within the interior volume of said shell, said tube bundle including a plurality of longitudinally extending heat exchange tubes arranged in an array of a plurality of vertical tube columns and a plurality of horizontal tube rows; a liquid refrigerant distributor disposed within said interior volume above said tube bundle, said liquid refrigerant distributor including: two liquid distribution chambers, each liquid distribution chamber having a bottom wall including a longitudinally extending distribution plate, said distributor plate having a plurality of laterally spaced and longitudinally extending channels, each channel of said plurality of channels aligned with a respective column of said plurality of vertical columns of heat exchange tubes and configured to deliver a falling flow of liquid refrigerant onto the respective tube column substantially uniformly along the longitudinal extent of the respective tube column, each channel of said plurality of channels of said distributor plate including: an upper slot extending along the longitudinal extent of said distributor plate; and two or more lower slits disposed at longitudinally spaced intervals beneath and in flow communication with said upper slot; wherein each of the upper slot and the two or more lower slits have longitudinal lengths greater than lateral widths; and a liquid leveling connector extending between the two liquid distribution chambers.

2. The shell and tube evaporator as set forth in claim 1 wherein said upper slot defines a longitudinally extending cavity having a width and a depth.

3. The shell and tube evaporator as set forth in claim 2 further comprising a porous material disposed within the cavity of said upper slot.

4. The shell and tube evaporator as set forth in claim 3 wherein said porous material comprises an aluminum foam or aluminum alloy foam.

5. The shell and tube evaporator as set forth in claim 1 further wherein each channel of said plurality of channels of said distributor plate includes:

an upper slot extending uninterruptedly along the longitudinal extent of said distributor plate; and a trough extending outwardly from an undersurface of said distributor plate and longitudinally beneath said upper slot, the trough including a plurality of lower slits disposed at longitudinally spaced intervals beneath and in flow communication with said upper slot.

6. The shell and tube evaporator as set forth in claim 5 wherein the trough has a distal tip having longitudinally extending outer sides that converge inwardly.

7. The shell and tube evaporator as set forth in claim 6 wherein the trough has the distal tip having longitudinally extending outer sides that converge inwardly at an angle with the horizontal in the range of 45 to 60 degrees.

8. The shell and tube evaporator as set forth in claim 1 further comprising a perforated plate disposed superadjacent an upper surface of said distributor plate, said perforated plate including a plurality of holes extending through said perforated plate, said plurality of holes arranged in a plurality of laterally spaced columns, each column including a plurality of longitudinally spaced holes and aligned above a respective one of the channels of said plurality of channels in said distributor plate.

9. The shell and tube evaporator as set forth in claim 1 wherein said liquid distributor further comprises:

a refrigerant inlet for receiving the refrigerant flow and opening to an upper region spaced above said bottom wall within the liquid distributor; and a first flow restrictor disposed in spaced relationship with and above said bottom wall, the first flow restrictor configured to initially redistribute the received refrigerant flow laterally.

10. The shell and tube evaporator as set forth in claim 9 wherein the first flow restrictor comprises a perforated plate.

11. The shell and tube evaporator as set forth in claim 9 wherein said liquid distributor further comprises a second flow restrictor disposed in spaced relationship with and above said bottom wall and beneath the first flow restrictor, the second flow restrictor configured to redistribute the received refrigerant flow longitudinally.

12. The shell and tube evaporator as set forth in claim 11 wherein the second flow restrictor comprises a perforated plate.

13. The shell and tube evaporator of claim 9, wherein the first flow restrictor comprises a sparge pipe.

14. The shell and tube evaporator of claim 13, wherein the sparge pipe includes one or more flow outlets at an upper surface of the sparge pipe.

15. The shell and tube evaporator of claim 1, wherein the liquid refrigerant distributor includes a vent opening to vent vapor refrigerant from the liquid refrigerant distributor.

16. The shell and tube evaporator of claim 15, wherein the vent opening is disposed at an upper wall of the liquid refrigerant distributor.

17. A modular liquid distributor comprising: two liquid distribution chambers, each liquid distribution chamber including an enclosure having a top wall, a bottom wall, a pair of laterally spaced side walls, and a pair of longitudinally spaced end walls, the top wall having an inlet opening for receiving a liquid to be distributed and the bottom wall including a longitudinally extending distribution plate, said distributor plate having a plurality of laterally spaced and longitudinally extending channels, each channel of said plurality of channels configured to deliver a falling flow of the liquid to be distributed substantially uniformly along a longitudinal extent of the liquid distributor, each channel of said plurality of channels having a longitudinal length greater than a lateral width; and a liquid leveling connector extending between the two liquid distribution chambers.

18. The liquid distributor as set forth in claim 17 further wherein each channel of said plurality of channels of said distributor plate includes:

an upper slot extending uninterruptedly along the longitudinal extent of said channel; and a plurality of lower slits disposed at longitudinally spaced intervals beneath and in flow communication with said upper slot.

19. The liquid distributor as set forth in claim 18 wherein said upper slot defines a longitudinally extending cavity having a width and a depth, and a porous material is disposed within the cavity of said upper slot.

20. The liquid distributor as set forth in claim 18 further wherein each channel of said plurality of channels of said distributor plate includes:

an upper slot extending uninterruptedly along the longitudinal extent of said channel; and a trough extending outwardly from an undersurface of said distributor plate and longitudinally beneath said upper slot, the trough including a plurality of lower slits disposed at longitudinally spaced intervals beneath and in flow communication with said upper slot.

21. The liquid distributor as set forth in claim 20 wherein the trough has a distal tip having longitudinally extending outer sides that converge inwardly at an angle with the horizontal in the range of 45 to 60 degrees.

22. The liquid distributor as set forth in claim 18 further comprising a perforated plate disposed superadjacent an upper surface of said distributor plate, said perforated plate including a plurality of holes extending through said perforated plate, said plurality of holes arranged in a plurality of laterally spaced columns, each column including a plurality of longitudinally spaced holes and aligned above a respective one of the channels of said plurality of channels in said distributor plate.

23. The liquid distributor as set forth in claim 18 further comprising a first flow restrictor disposed in spaced relationship with and above the bottom wall, the first flow restrictor configured to initially redistribute the received refrigerant flow laterally, the first flow restrictor being a perforated plate; and a second flow restrictor disposed in spaced relationship with and above the bottom wall and beneath the first flow restrictor, the second flow restrictor configured to redistribute the received refrigerant flow longitudinally, the second flow restrictor being a perforated plate.

* * * * *